US005323917A

United States Patent [19]

Johnson et al.

[11] Patent Number: 5,323,917

[45] Date of Patent: Jun. 28, 1994

[54] REFRIGERATOR RACK

[75] Inventors: Warren F. Johnson; Kenneth M. Hattori; Roger E. Hamilton, all of Galesburg, Ill.

[73] Assignee: Maytag Corporation, Newton, Iowa

[21] Appl. No.: 994,699

[22] Filed: Dec. 22, 1992

[51] Int. Cl.[5] ..... A47F 7/00

[52] U.S. Cl. ..... 211/74; 211/59.2; 312/45; 248/311.2

[58] Field of Search ..... 211/74, 59.2, 181, 134; 248/311.2; 312/45, 72

[56] References Cited

U.S. PATENT DOCUMENTS

| | | | |
|---|---|---|---|
| Des. 233,817 | 12/1974 | Stanmore . | |
| 2,008,315 | 7/1935 | Schmidt . | |
| 2,138,418 | 11/1938 | Fahrne . | |
| 2,239,369 | 4/1941 | Nauert . | |
| 2,588,618 | 3/1952 | Di Renzo | 211/59.2 X |
| 2,852,327 | 9/1958 | Mason . | |
| 3,371,790 | 3/1968 | Crouch et al. . | |
| 3,805,964 | 4/1974 | Titus | 211/59.2 |
| 3,814,293 | 6/1974 | Daves . | |
| 4,105,126 | 8/1978 | Deffner et al. . | |
| 4,228,903 | 10/1980 | Eckert | 211/59.2 |
| 4,423,818 | 1/1984 | Sparner | 211/59.2 |
| 4,515,334 | 5/1985 | Horne . | |
| 4,776,470 | 10/1988 | Chap | 211/59.2 |
| 4,936,641 | 6/1990 | Bussan et al. . | |
| 4,998,628 | 3/1991 | Ross | 312/45 X |

*Primary Examiner*—Gibson, Jr. Robert W.
*Attorney, Agent, or Firm*—Bacon & Thomas

[57] ABSTRACT

A rack supportable on a refrigerator shelf for storing a bottle of wine, a carton of eggs or a plurality of cylindrical beverage cans. The rack includes a vertical sidewall terminating in an inwardly directed top flange for engaging the refrigerator shelf, a longitudinal depression in a bottom wall for supporting the wine bottle and an incline in the bottom wall for permitting the beverage cans to automatically self-feed towards the front of the rack.

10 Claims, 3 Drawing Sheets

FIG. 1
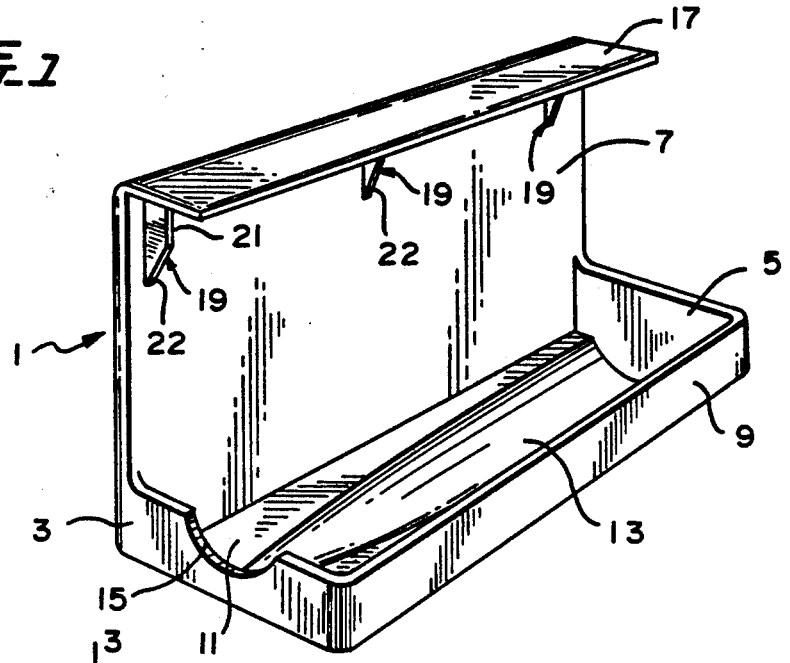
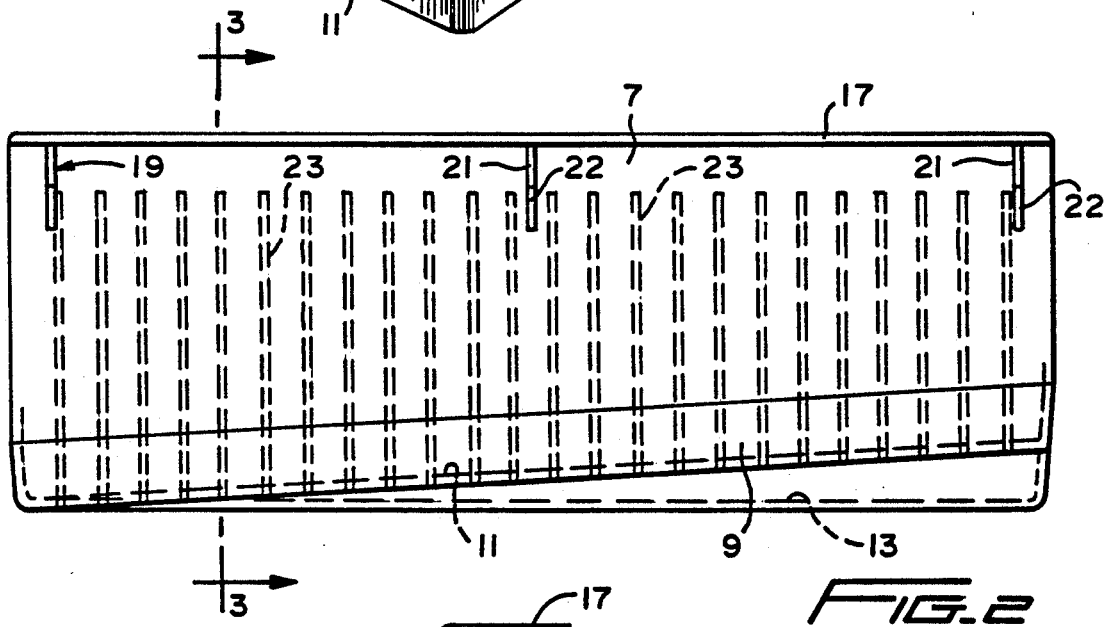
FIG. 2
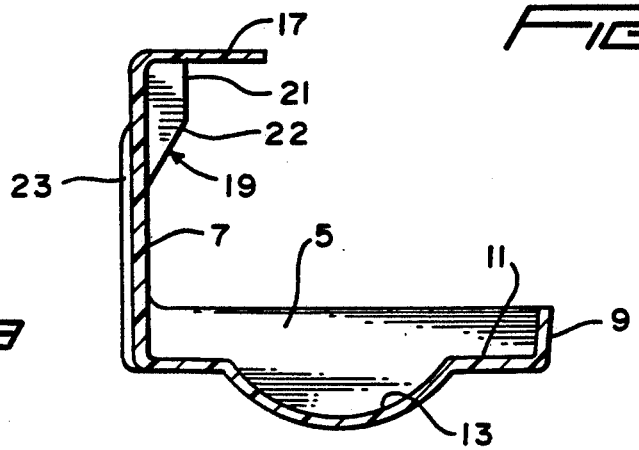
FIG. 3

FIG. 4
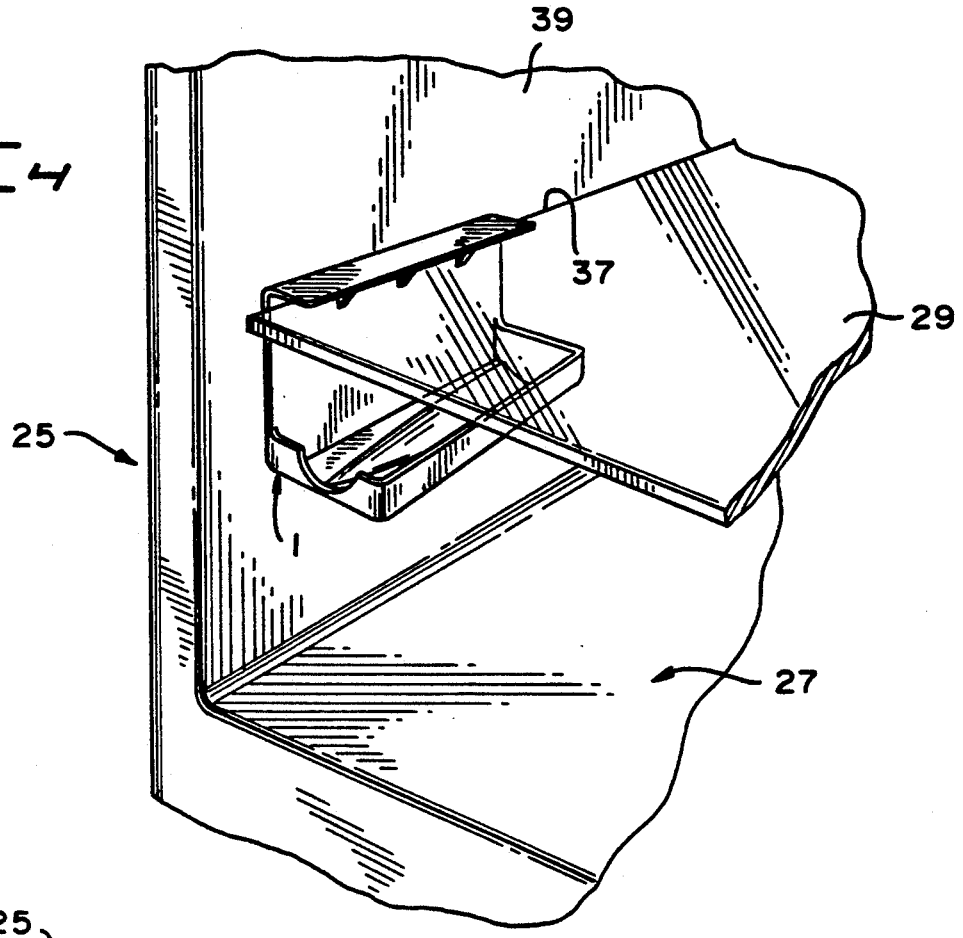
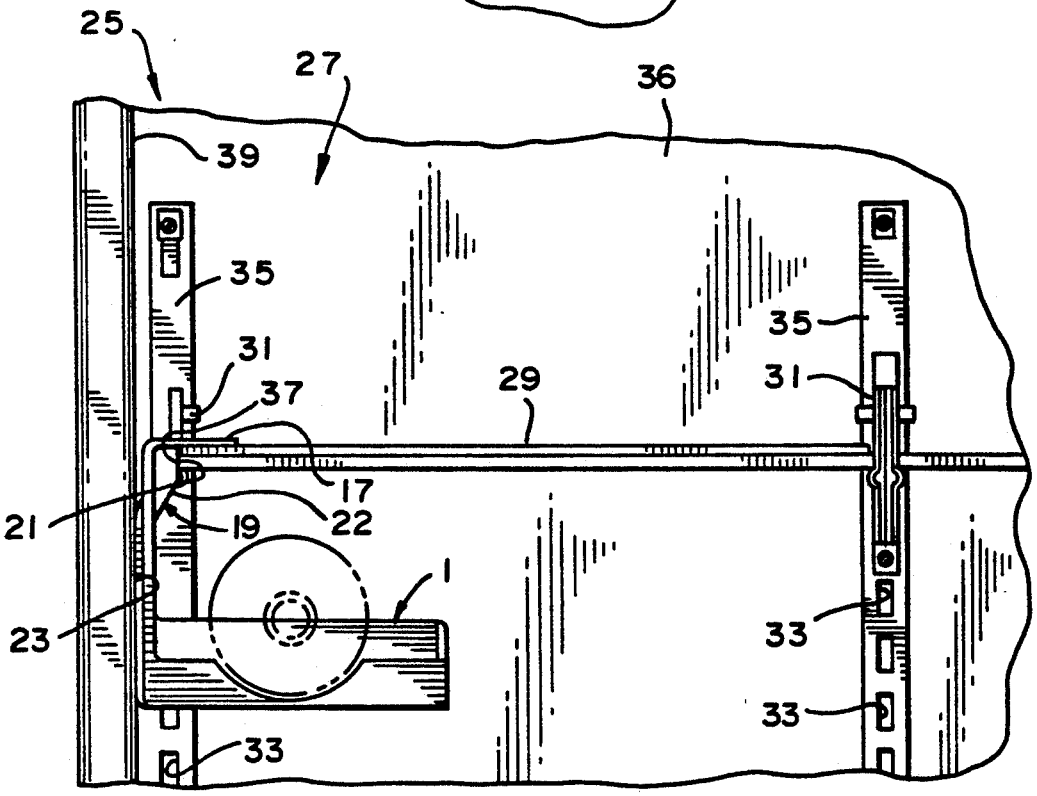
FIG. 5

REFRIGERATOR RACK

BACKGROUND OF THE INVENTION

1. Field of the Invention

The present invention generally involves the field of technology pertaining to shelving and racks for supporting articles. More particularly, the invention relates to an improved rack for use in a refrigerator to store and dispense a variety of articles.

2. Description of the Prior Art

It is known to provide a conventional household refrigerator with a separate rack for storing and dispensing different articles. Such a rack may be supported on the existing shelf structure of the refrigerator and is specifically designed for containing the desired article. For example, it is known to provide a rack that is designed to store a plurality of cylindrical beverage cans which may self-feed towards the dispensing end of the rack. It is further known to provide a rack designed to support one or more wine bottles in a horizontal position. Moreover, racks specifically designed to support eggs are also known.

Conventional refrigerator racks of this type are disadvantageous in that each rack is specifically designed for a given article, thereby requiring different racks if more than one type of article is desired to be stored and dispensed. Moreover, known racks have complex structures formed from wire or panels, and are expensive to manufacture.

SUMMARY OF THE INVENTION

It is an object of the present invention to provide an improved refrigerator rack for storing and dispensing a variety of articles.

It is an other object of the invention to provide an improved refrigerator rack which is of simple construction and economical to manufacture.

It is a further object of the invention to provide an improved storage rack which may be easily detachably secured to the existing shelving structure of a conventional refrigerator.

The foregoing and other objects of the invention are realized by providing a refrigerator rack which is in the form of a rectangular-shaped compartment defined by a front wall, a back wall, a bottom wall and a pair of side walls. One side wall extends vertically above the other side wall and terminates in an inwardly directed flange for supporting the rack from a refrigerator shelf in a cantilever manner. The bottom wall includes a longitudinal depression for supporting a wine bottle. The bottom wall is also inclined towards the back wall so that a plurality of cylindrical beverage cans stored in the compartment may automatically self feed towards the front wall during removal of the frontmost can. The compartment is also sized to receive a standard carton of eggs.

Other objects, features and advantages of the invention shall become apparent from the following detailed description of a preferred embodiment thereof, when taken in conjunction with the drawings wherein like reference characters refer to corresponding parts in the several views.

BRIEF DESCRIPTION OF THE DRAWINGS

FIG. 1 is a perspective view of a refrigerator rack according to a preferred embodiment of the invention.

FIG. 2 is a right side elevational view of the rack shown in FIG. 1;

FIG. 3 is a cross-sectional view taken along the line 3—3 of FIG. 2;

FIG. 4 is a perspective view showing the rack secured to an existing shelf in a conventional refrigerator;

FIG. 5 is a front elevational view of the rack shown in FIG. 4 with a wine bottle supported therein.

DETAILED DESCRIPTION OF THE PREFERRED EMBODIMENT

Figure 6:
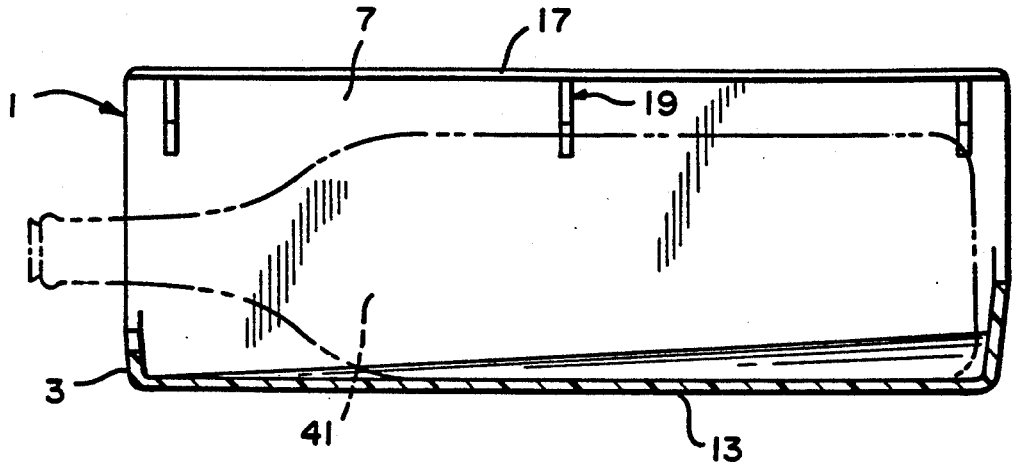
FIG. 6 is a side elevational view taken in cross section of the rack shown in FIG. 5.

A refrigerator rack 1, according to a preferred embodiment of the invention, shall now be described with initial reference to FIGS. 1-3. As shown therein, rack 1 is essentially in the form of a substantially rectangular-shaped compartment defined by a front wall 3, a back wall 5, a left side wall 7, a right side wall 9 and a bottom wall 11.

Bottom wall 11 is inclined from front wall 3 towards back wall 5 in order to permit cylindrical articles, such as beverage cans, to automatically self feed towards front wall 3 during removal of the frontmost can by the user. The degree of inclination is preferably about 3°. As also shown, bottom wall 11 is provided with a longitudinal depression 13 integrally formed therein. Depression 13 preferably extends for substantially the entire length of bottom wall 11 in a tapering configuration from back wall 5 towards front wall 3. Depression 13 serves the purpose of receiving and supporting a wine bottle within rack 1, and should therefore be sized and configured accordingly for this purpose. A semi circular-shaped notch 15 is also provided in front wall 3 for facilitating manual access to articles stored in rack 1.

As also apparent from FIGS. 1-3, left side wall 7 extends vertically above right side wall 9 for a considerable distance and terminates in an inwardly directed right angle flange 17. A plurality of spaced brace members 19 are positioned at the internal right angle juncture between side wall 7 and flange 17 for providing reinforcement. Each member 19 includes a front vertical face 21 and a downwardly angled face 22.

The external surface of sidewall 7 is provided with a plurality of spaced vertically extending ribs 23 which serve to impart rigidity and strength to sidewall 7. In a preferred embodiment, sidewall 7 may be provided with twenty-four ribs 23 horizontally spaced along substantially the entire length of sidewall 7. Ribs 23 also interface with the inner cabinet wall of a refrigerator in a manner to be later described herein.

It is preferred that rack 1 be integrally molded from an appropriate plastic material having the required physical characteristics deemed sufficient for the practice of the invention as disclosed herein. It is of course understood that rack 1 may be made from any other suitable materials, whether integrally formed or constructed from separate components.

The installation of rack 1 within a conventional refrigerator shall now be described with particular reference to FIGS. 4 and 5. A refrigerator 25 is shown to include a cabinet 27 within which a shelf 29 is provided. Shelf 29 is supported in a conventional cantilever manner. This is accomplished by providing a plurality of brackets 31 at the rear edge of shelf 29 for selective engagement within a plurality of spaced apertures 33 formed in a plurality of vertical support strips 35 that are secured to an inner back wall 36 of cabinet 27. It is important to note that when shelf 29 is supported in this cantilever manner, it includes a side edge 37 which is spaced from an inner side wall 39 of cabinet 27. As is therefore apparent, rack 1 is detachably secured to shelf 29 by longitudinally inserting rack 1 into the spacing between edge 37 and side wall 39. This disposes the outer edges of ribs 23 of left side wall 7 against side wall 39 of cabinet 27, edge 37 of shelf 29 in abutting engagement against vertical surfaces 21 of brace members 19 and the inner surface of flange 17 in overlying engagement on the upper surface of shelf 29. As clearly shown in FIG. 5, rack 1 is properly located with respect to cabinet 27 and securely supported on shelf 29, but may be easily removed by merely sliding rack 1 outwardly of cabinet 27. Brace members 19 and ribs 23 collectively serve to provide a high degree of strength and rigidity to rack 1 for supporting relatively heavy articles therein.

Figure 7:
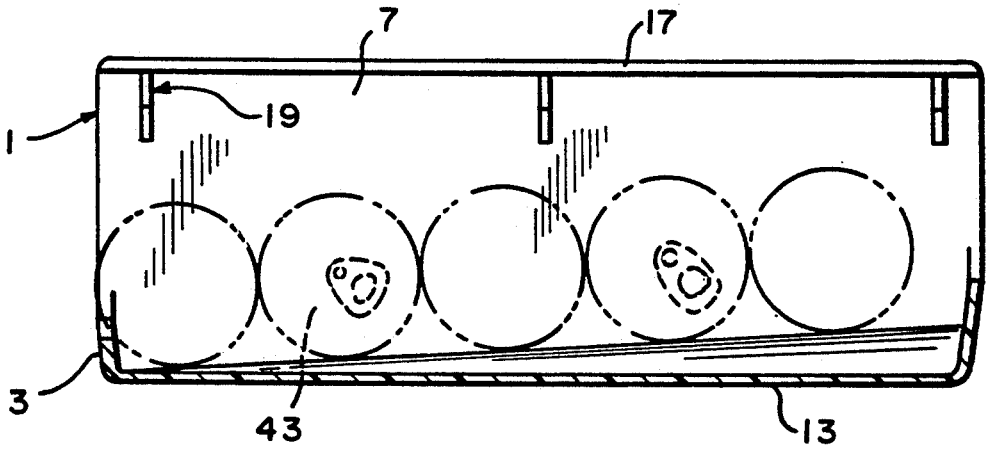
FIG. 7 is a side view taken in cross section of the rack shown in FIG. 4 with a plurality of cylindrical beverage cans supported in the rack for self feeding towards the front thereof.
Figure 8:
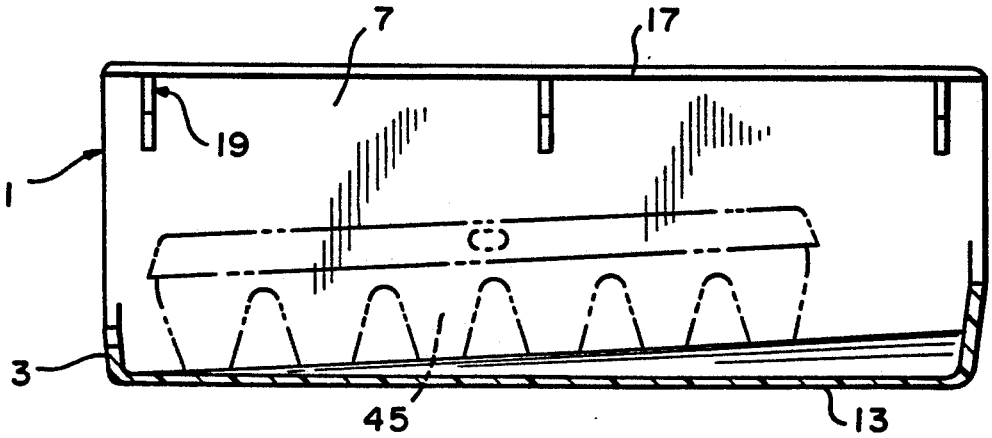
FIG. 8 is a side view taken in cross section of the rack shown in FIG. 4 with a standard egg carton supported in the rack.

Examples of articles which may be supported by rack 1 are exemplified with reference to FIGS. 6–8. As seen in FIG. 6, a wine bottle 41 is cradled within depression 13 of rack 1 and may be easily removed from or replaced therein due to the open configuration of rack 1. As indicated in FIG. 7, a plurality of cylindrical beverage cans 43 may be stored on the inclined bottom wall 11 of rack 1 so that cans 43 may automatically self feed toward front wall 3 of rack 1 during removal of the frontmost can by the user. As finally shown in FIG. 8, the compartment defined by rack 1 may be sized to receive a conventional egg carton 45 which is also easily placed within or removed from rack 1 due to its open configuration. It is of course understood that FIGS. 6–8 only provide examples of certain preferred articles which are capable of being effectively stored within and removed from rack 1 due to the structural characteristics of rack 1 as disclosed herein, but that rack 1 may also be utilized to advantage in the storage of other articles of different sizes and configurations.

The drawings depict rack 1 in a configuration suitable for installation at the left side of shelf 29 with respect to the front opening of cabinet 27. However, it is to be understood that a reverse or right hand configuration of rack 1 may also be formed for installation on the right side of shelf 29, wherein the latter configuration shall also incorporate all of the structural and functional details of rack 1 as disclosed herein.

Though the invention has been described herein with reference to a preferred embodiment thereof, it shall be understood that various changes and modifications of the invention may be resorted to by one of ordinary skill in the art without departing from the spirit and scope of the invention as defined by the appended claims.

We claim:

1. A rack for storing articles in a refrigerator comprising:

a) a rectangular-shaped compartment defined by a pair of side walls, a front wall, a back wall and a bottom wall;

b) one side wall extending vertically above the other side wall and terminating in an inwardly extending top flange for supporting the rack from a refrigerator shelf; and c) the bottom wall being inclined from the front wall towards the back wall for permitting cylindrical articles in the compartment to self feed towards the front wall.

2. The rack of claim 1 wherein the bottom wall further includes a depression formed therein for supporting a wine bottle.

3. The rack of claim 2 wherein the depression extends longitudinally along substantially a major portion of the bottom wall and tapers from the back wall towards the front wall.

4. The rack of claim 1 further including a plurality of brace members spaced along the juncture between adjacent inner surfaces of the one side wall and the top flange with each brace member including a vertical face for engaging a side edge of the refrigerator shelf.

5. The rack of claim 1 further including a semi circular notch formed in the front wall for facilitating manual access to an article stored in the compartment.

6. The rack of claim 1 wherein substantially the entire rack is integrally formed of plastic material.

7. The rack of claim 1 wherein the top flange extends for substantially the entire length of the one side wall.

8. The rack of claim 1 wherein the bottom wall is inclined approximately three degrees.

9. The rack of claim 1 wherein the one side wall includes an external surface and a plurality of vertically extending ribs spaced along the external surface.

10. The rack of claim 9 wherein the ribs are horizontally spaced along substantially the entire length of the external surface.

* * * * *